US009859038B2

(12) United States Patent
Davis et al.

(10) Patent No.: US 9,859,038 B2
(45) Date of Patent: Jan. 2, 2018

(54) SURFACE MODIFIED OVERHEAD CONDUCTOR

(71) Applicant: General Cable Technologies Corporation, Highland Heights, KY (US)

(72) Inventors: Cody R. Davis, Maineville, OH (US); Sathish Kumar Ranganathan, Plainfield, IN (US); Ryan Andersen, Williamsport, PA (US); Vijay Mhetar, Westfield, IN (US); William S. Temple, Loveland, OH (US); Srinivas Siripurapu, Carmel, IN (US); Gordon Baker, Milford, OH (US); James Freestone, Danville, IN (US); Dennis L. Doss, Williamsburg, OH (US)

(73) Assignee: General Cable Technologies Corporation, Highland Heights, KY (US)

( * ) Notice: Subject to any disclaimer, the term of this patent is extended or adjusted under 35 U.S.C. 154(b) by 1120 days.

(21) Appl. No.: 13/863,902

(22) Filed: Apr. 16, 2013

(65) Prior Publication Data

US 2014/0041925 A1 Feb. 13, 2014

Related U.S. Application Data

(60) Provisional application No. 61/681,926, filed on Aug. 10, 2012, provisional application No. 61/702,120, filed on Sep. 17, 2012, provisional application No. 61/769,492, filed on Feb. 26, 2013, provisional application No. 61/800,608, filed on Mar. 15, 2013.

(51) Int. Cl.

| | |
|---|---|
| ***B05D 5/12*** | (2006.01) |
| ***H01B 7/29*** | (2006.01) |
| ***H01B 13/30*** | (2006.01) |
| ***H01B 3/00*** | (2006.01) |
| ***H01B 3/46*** | (2006.01) |
| ***H01B 5/00*** | (2006.01) |
| ***H01B 3/02*** | (2006.01) |
| ***H01B 3/10*** | (2006.01) |
| *H01B 7/42* | (2006.01) |

(52) U.S. Cl.

CPC ..... *H01B 7/29* (2013.01); *H01B 3/008* (2013.01); *H01B 3/02* (2013.01); *H01B 3/10* (2013.01); *H01B 3/46* (2013.01); *H01B 5/002* (2013.01); *H01B 13/30* (2013.01); *H01B 7/421* (2013.01)

(58) Field of Classification Search

CPC combination set(s) only.

See application file for complete search history.

(56) References Cited

U.S. PATENT DOCUMENTS

| | | | | |
|---|---|---|---|---|
| 2,650,975 | A | 9/1953 | Dorst | |
| 3,278,673 | A | 10/1966 | Gore | |
| 3,383,188 | A * | 5/1968 | Michelson | C22C 21/00 174/126.1 |
| 3,895,956 | A | 7/1975 | Yoshida et al. | |
| 4,149,367 | A * | 4/1979 | Eistrat | H01B 13/00 174/128.1 |
| 4,288,252 | A | 9/1981 | Neely | |
| 4,288,974 | A * | 9/1981 | Eistrat | H01B 13/00 57/217 |
| 4,347,285 | A | 8/1982 | Batdorf | |
| 4,358,637 | A | 11/1982 | Lanfranconi | |
| 4,369,204 | A | 1/1983 | Wolf et al. | |
| 4,383,133 | A | 5/1983 | Lanfranconi | |
| 4,407,062 | A | 10/1983 | Sutcliffe et al. | |
| 4,463,219 | A | 7/1984 | Sato | |
| 4,513,173 | A | 4/1985 | Merry | |
| 4,575,184 | A | 3/1986 | Ueno et al. | |
| 4,755,629 | A | 7/1988 | Beggs et al. | |
| 4,784,461 | A | 11/1988 | Abe et al. | |
| 4,912,286 | A | 3/1990 | Clarke | |
| 5,066,330 | A | 11/1991 | Holcombe, Jr. et al. | |
| 5,091,609 | A | 2/1992 | Sawada et al. | |
| 5,164,003 | A | 11/1992 | Bosco et al. | |
| 5,177,809 | A | 1/1993 | Zeidler et al. | |
| 5,194,087 | A | 3/1993 | Berg | |
| 5,296,288 | A | 3/1994 | Kourtides et al. | |
| 5,330,794 | A | 7/1994 | Bosco et al. | |
| 5,336,851 | A | 8/1994 | Sawada et al. | |

(Continued)

FOREIGN PATENT DOCUMENTS

| | | |
|---|---|---|
| CL | 3425-2008 | 11/2008 |
| CL | 3435-2008 | 11/2008 |

(Continued)

OTHER PUBLICATIONS

AZO material online database for aluminum oxide (provided as evidence).*

Vargas, Hector Javier Sanchez; Office Action issued in Mexican Patent Application No. MX/a/2015/001771; dated Dec. 7, 2016; 14 pages, including English translation.

Akagashi, Yuki; Notice of Reasons for Rejection issued in Japanese Patent Application No. 2015-526528; dated Dec. 19, 2016; 11 pages including English translation.

Sanchez, Ronaldo; Examination Report No. 1 for Standard Patent Application, issued in Australian Patent Application No. 2014223867; dated Feb. 10, 2017; 3 pages.

Song, Li; Second Office Action issued in Chinese Patent Application No. 201380053188.X; dated Jan. 26, 2017; 8 pages, including English translation.

(Continued)

*Primary Examiner* — Austin Murata

(74) *Attorney, Agent, or Firm* — Ulmer & Berne LLP

(57) ABSTRACT

The present invention relates to a surface modified overhead conductor with a coating that allows the conductor to operate at lower temperatures. The coating is an inorganic, non-white coating having durable heat and wet aging characteristics. The coating preferably contains a heat radiating agent with desirable properties, and an appropriate binder/suspension agent. In a preferred embodiment, the coating has L* value of less than 80, a heat emissivity of greater than or equal to 0.5, and/or a solar absorptivity coefficient of greater than 0.3.

7 Claims, 10 Drawing Sheets

(56) References Cited

U.S. PATENT DOCUMENTS

| | | | |
|---|---|---|---|
| 5,372,886 | A | 12/1994 | Inazawa et al. |
| 5,468,290 | A | 11/1995 | Kelley |
| 5,554,826 | A | 9/1996 | Gentry |
| 5,828,007 | A | 10/1998 | Fujishita et al. |
| 6,007,873 | A | 12/1999 | Holcombe, Jr. et al. |
| 6,013,372 | A | 1/2000 | Hayakawa et al. |
| 6,136,434 | A | 10/2000 | Jang et al. |
| 6,239,379 | B1 | 5/2001 | Cotter et al. |
| 6,295,401 | B1 | 9/2001 | Rutterman et al. |
| 6,362,121 | B1 | 3/2002 | Chopin et al. |
| 6,589,661 | B2 | 7/2003 | Neely, Jr. |
| 6,687,437 | B1 | 2/2004 | Starnes et al. |
| 6,797,147 | B2 | 9/2004 | Dolan |
| 6,916,414 | B2 | 7/2005 | Dolan |
| 6,921,431 | B2 | 7/2005 | Evans et al. |
| 6,973,243 | B2 | 12/2005 | Koyasu et al. |
| 7,015,395 | B2 | 3/2006 | Goldsworthy et al. |
| 7,105,047 | B2 | 9/2006 | Simmons et al. |
| 7,244,470 | B2 | 7/2007 | Niles |
| 7,313,909 | B2 | 1/2008 | Skoog et al. |
| 7,354,650 | B2 | 4/2008 | Nakajima et al. |
| 7,438,971 | B2 | 10/2008 | Bryant et al. |
| 7,449,245 | B2 | 11/2008 | Akarsu et al. |
| 7,534,964 | B2 | 5/2009 | Clark et al. |
| 7,612,289 | B2 | 11/2009 | Lique et al. |
| 7,643,713 | B2 | 1/2010 | Buthe et al. |
| 7,752,754 | B2 | 7/2010 | Goldsworthy et al. |
| 7,820,300 | B2 | 10/2010 | Dolan |
| 7,834,271 | B2 | 11/2010 | Gromko et al. |
| 7,897,875 | B2 | 3/2011 | Gareis |
| 7,954,518 | B2 | 6/2011 | Torrance et al. |
| 8,204,348 | B2 | 10/2012 | Keller et al. |
| 8,295,665 | B2 | 10/2012 | Herbest |
| 8,319,104 | B2 | 11/2012 | Camp, II et al. |
| 8,361,630 | B2 | 1/2013 | Dolan |
| 8,625,946 | B2 | 1/2014 | Kachmar |
| 8,718,428 | B2 | 5/2014 | Hurley et al. |
| 9,011,791 | B2 | 4/2015 | Olver et al. |
| 2004/0016503 | A1 | 1/2004 | Stowe |
| 2005/0064094 | A1 | 3/2005 | Wojtysiak et al. |
| 2005/0279074 | A1 | 12/2005 | Johnson et al. |
| 2005/0279527 | A1 | 12/2005 | Johnson et al. |
| 2006/0237221 | A1 | 10/2006 | Glew |
| 2007/0148479 | A1 | 6/2007 | Ishikazi et al. |
| 2007/0193767 | A1 | 8/2007 | Guery et al. |
| 2007/0193769 | A1 | 8/2007 | Clark et al. |
| 2008/0128155 | A1 | 6/2008 | Guery et al. |
| 2008/0210567 | A1 | 9/2008 | Karuppuchamy et al. |
| 2008/0264670 | A1 | 10/2008 | Glew |
| 2009/0078439 | A1 | 3/2009 | Wiekhorst |
| 2009/0114420 | A1 | 5/2009 | Winterhalter |
| 2009/0126971 | A1 | 5/2009 | Fok |
| 2009/0293786 | A1 | 12/2009 | Olver |
| 2010/0076719 | A1 | 3/2010 | Lawry et al. |
| 2010/0252241 | A1 | 10/2010 | McDermott et al. |
| 2012/0074122 | A1 | 3/2012 | Olver et al. |
| 2012/0090892 | A1 | 4/2012 | Meyer et al. |
| 2012/0106591 | A1 | 5/2012 | Springer, III |
| 2012/0141778 | A1 | 6/2012 | Phipps |
| 2012/0172209 | A1 | 7/2012 | Lu et al. |
| 2012/0222883 | A1 | 9/2012 | Nordin et al. |
| 2012/0267141 | A1 | 10/2012 | Kamiyama et al. |
| 2012/0312579 | A1 | 12/2012 | Kenny et al. |
| 2013/0014972 | A1 | 1/2013 | Wiebelhaus et al. |
| 2014/0041925 | A1 | 2/2014 | Davis et al. |
| 2014/0238867 | A1 | 8/2014 | Ranganathan et al. |
| 2015/0235739 | A1 | 8/2015 | Davis et al. |

FOREIGN PATENT DOCUMENTS

| | | | |
|---|---|---|---|
| CN | 101002288 | A | 7/2007 |
| CN | 200979826 | Y | 11/2007 |
| CN | 101125979 | A | 2/2008 |
| CN | 201773611 | U | 3/2011 |
| CN | 101752023 | B | 9/2011 |
| CN | 102439093 | A | 5/2012 |
| CN | 102446578 | A | 5/2012 |
| CN | 102471637 | A | 5/2012 |
| CN | 102977700 | A | 3/2013 |
| CN | 203038717 | U | 7/2013 |
| DE | 3824608 | C1 | 8/1989 |
| DE | 9410584 | | 9/1994 |
| EP | 0756289 | A1 | 1/1997 |
| EP | 0981192 | A1 | 2/2000 |
| EP | 2544190 | A1 | 1/2013 |
| ES | 2015171 | A6 | 8/1990 |
| FR | 2971617 | A1 | 8/2012 |
| GB | 437310 | | 10/1935 |
| GB | 2079521 | A | 1/1982 |
| GB | 2123164 | | 1/1984 |
| JP | S57-180808 | A | 11/1982 |
| JP | H04-075206 | A | 3/1992 |
| JP | 8-315653 | A | 11/1996 |
| JP | 2001-52539 | | 2/2001 |
| JP | 2003-132746 | | 5/2003 |
| JP | 2009-026699 | A | 2/2009 |
| MX | 2011009259 | A | 8/2012 |
| RU | 2386183 | C1 | 4/2010 |
| WO | 99/048182 | A1 | 9/1999 |
| WO | 2004109797 | A1 | 12/2004 |
| WO | 2005005680 | A2 | 1/2005 |
| WO | 2006136335 | A1 | 12/2006 |
| WO | 2007/034248 | A1 | 3/2007 |
| WO | 2007034248 | A1 | 3/2007 |
| WO | 2010042191 | A1 | 4/2010 |

OTHER PUBLICATIONS

Gonzalez, Cecilia Veronica Lanas; Office Action issued in Chilean Patent Application No. 0320-2015; dated Feb. 3, 2017; 18 pages, including English translation.

Zhang, Qiuhong; First Office Action and Search Report, issued in Chinese Patent Application No. 201380053188.X; dated Mar. 31, 2016; 27 pages, including English translation.

Gonzalez; Cecilia Veronica Lanas; Office Action issued in Chilean Patent Application No. 2015-000320; dated Jul. 27, 2016; 17 pages, including English translation.

Gnanasingham, Soosa; Patent Examination Report No. 1, issued in Australian Patent Application No. 2013300127; dated Jul. 22, 2016; 4 pages.

Lopez, Ricardo E.; Non-Final Office Action issued in U.S. Appl. No. 14/701,220; dated Oct. 21, 2016; 14 pages.

Vargas, Hector Javier Sanchez; Office Action issued in Mexican Patent Application No. MX/a/2015/001771; 11 pages, including partial English translation.

Young, Lee W.; International Search Report and Written Opinion of the International Searching Authority, issued in International Application No. PCT/US2016/043429; dated Oct. 13, 2016; 7 pages.

Alaqil, Saleh, M.; Examination Report issued in GCC Pat. App. No. GC 2013-25627; dated Feb. 8, 2017; 4 pages.

Hillmayr, Heinrich; Extended European Search Report, including supplementary European search report and European search opinion, issued in European Patent Application No. 13827181.2; dated Mar. 16, 2016; 9 pages.

Copenheaver, Blaine R.; International Search Report and Written Opinion of the International Searching Authority, issued in International Application No. PCT/US2014/062181; dated Feb. 9, 2015; 9 pages.

Thomas, Shane; International Search Report and Written Opinion of the International Searching Authority, issued in International Application No. PCT/US2015/010619; dated Mar. 25, 2015; 8 pages.

Thomas, Shane; International Search Report and Written Opinion of the International Searching Authority, issued in International Application No. PCT/US2015/035137; dated Sep. 4, 2015; 9 pages.

Thomas, Shane; International Search Report and Written Opinion of the International Searching Authority, issued in International Application No. PCT/US2015/010637; dated Mar. 25, 2015; 9 pages.

Schedrina, O.; International Search Report and Written Opinion of the International Searching Authority, issued in International application No. PCT/US2013/037433; dated Aug. 8, 2013; 5 pages.

(56) References Cited

OTHER PUBLICATIONS

Kim, Tae Hoon; International Search Report and Written Opinion of the International Searching Authority, issued in International application No. PCT/US2014/017736; dated May 20, 2014; 13 pages.
Vanier, Cecile; Extended European Search Report, including supplementary European search report and European search opinion, issued in European Patent Application No. 147568681; dated Aug. 16, 2016; 6 pages.
Office Action issued in Taiwanese Patent Application No. 102138290; dated Jul. 28, 2017; 14 pages, including English translation.
Campos M., Celia; Examination Report issued in Chilean Patent Application No. 2015-2382; dated Jun. 19, 2017; 22 pages, including English translation.
Zhang, Qiuhong; Office Action issued in Chinese Patent Application No. 201380053188.X; dated Aug. 14, 2017; 17 pages, including English translation.
Varghese, Roshn; Non-final Office Action issued in U.S. Appl. No. 14/185,429; dated Sep. 7, 2017; 28 pages.
Paden, Leodelino C.; Substantive Examination Report issued in Philippines Patent Application No. 1-2015-500273; dated Sep. 5, 2017; 2 pages.
Lopez, Ricardo E.; Final Office Action issued in U.S. Appl. No. 14/701,220; dated Jul. 13, 2017; 8 pages.
Alvear, Mariana Olimpia Castro; Office Action issued in Mexican Patent Application No. MX/a/2015/001771; dated Jun. 27, 2017; 16 pages, including English translation.

* cited by examiner (Temperature in °C vs. Hours)

SURFACE MODIFIED OVERHEAD CONDUCTOR

This application claims the priority of U.S. Provisional Application Nos. 61/681,926, filed Aug. 10, 2012; 61/702,120, filed Sep. 17, 2012; 61/769,492, filed Feb. 26, 2013; and 61/800,608, filed Mar. 15, 2013; which are incorporated herein by reference.

FIELD OF THE INVENTION

The present invention relates to a surface modified overhead conductor with a coating that allows the conductor to operate at lower temperatures.

BACKGROUND OF THE INVENTION

As the need for electricity continues to grow, the need for higher capacity transmission and distribution lines grows as well. The amount of power a transmission line can deliver is dependent on the current-carrying capacity (ampacity) of the line. The ampacity of a line is limited by the maximum safe operating temperature of the bare conductor that carries the current. Exceeding this temperature can result in damage to the conductor or the accessories of the line. Moreover, the conductor gets heated by Ohmic losses and solar heat and it gets cooled by conduction, convection and radiation. The amount of heat generated due to Ohmic losses depends on current (I) passing through it and its electrical resistance (R) by the relationship Ohmic losses=$I^2R$. Electrical resistance (R) itself is dependent on temperature. Higher current and temperature leads to higher electrical resistance, which, in turn, leads to more electrical losses in the conductor.

Several solutions have been proposed in the art. WO 2007/034248 to Simic discloses overhead conductors coated with a spectrally selective surface coating. The coating has a coefficient of heat emission (E) higher than 0.7 and coefficient of solar absorption (A) that is less than 0.3. Simic also requires that the surface be white in color to have low solar absorption.

DE 3824608 discloses an overhead cable having a black paint coating with an emissivity greater than 0.6, preferably greater than 0.9. The paint is made of a plastic (e.g. polyurethane) and black color pigment.

FR 2971617 discloses an electric conductor coated with a polymeric layer whose emissivity coefficient is 0.7 or more and solar absorption coefficient is 0.3 or less. The polymeric layer is produced from polyvinylidene fluoride (PVDF) and a white pigment additive.

Both FR 2971617 and WO 2007/034248 require white coatings that are not desirable due to glare and discoloration over time. Both DE 3824608 and FR 2971617 require polymeric coatings that are not desirable due to their questionable heat and wet aging characteristics.

Therefore, there remains a need for a durable, inorganic, non-white coating for overhead conductors that allow the conductors to operate at reduced temperatures.

SUMMARY OF THE INVENTION

The temperature of the conductor is dependent on a number of factors including the electrical properties of the conductor, the physical properties of the conductor, and the local weather conditions. One way the conductor will increase in temperature is by absorbing heat from the sun due to solar radiation. The amount of heat absorbed is dependent on the surface of the conductor, that is, the surface's coefficient of absorptivity ("absorptivity"). A low absorptivity indicates that the conductor absorbs only a small amount of heat due to solar radiation.

One way the conductor reduces temperature is by emitting heat through radiation. The amount of heat radiated is dependent on the conductor surface's coefficient of emissivity ("emissivity"). The high emissivity indicates that the conductor is radiating more heat than a conductor with low emissivity.

Accordingly, it is an object of the present invention to provide an overhead conductor that contains a heat radiating agent that, when tested in accordance to ANSI C119.4-2004, reduces the operating temperature of the conductor compared to the temperature of the same conductor without the heat radiating agent. The heat radiating agent can be incorporated directly into the conductor or coated on the conductor. Preferably, the operating temperature is reduced by at least 5° C.

A further object of the present invention provides an inorganic, non-white coating for overhead conductors having durable heat and wet aging characteristics. The coating preferably contains a heat radiating agent with desirable properties, and an appropriate binder/suspension agent. In a preferred embodiment, the coating has a heat emissivity of greater than or equal to 0.5 and/or a solar absorptivity coefficient of greater than 0.3. In preferred embodiments, the coating has a thermal expansion similar to that of the conductor, about $10\times10^{-6}$ to about $100\times10^{-6}$/° C. over a temperature range of 0-250° C.

A yet further object of the present invention provides methods for coating an overhead conductor with an inorganic, non-white, flexible coating that reduces the operating temperature of the conductor compared to the temperature of the same conductor without the heat radiating agent.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DETAILED DESCRIPTION OF THE PREFERRED EMBODIMENT

Figure 1:
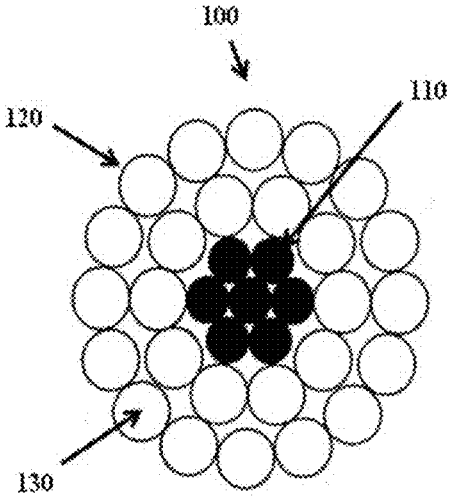
FIG. 1 is a cross sectional view of a conductor in accordance with one embodiment of the present invention.

The present invention provides an overhead conductor that contains an outer coating that, when tested in accordance to ANSI C119.4-2004, reduces the operating temperature of the conductor compared to the temperature of the same conductor without the heat radiating agent. The heat radiating agent can be incorporated directly into the conductor or coated on the conductor. Preferably, the operating temperature is reduced by at least 5° C.

In an embodiment, the present invention provides a bare overhead conductor with an surface coating to decrease the operating temperature of the conductor without significant change to any electrical or mechanical properties, such as electrical resistance, corona, elongation at rupture, tensile strength, and modulus of elasticity for example. The coating layer of the present invention is preferably non-white. CIE Publication 15.2 (1986), section 4.2 recommends the CIE L*, a*, b* color scale for use. The color space is organized as a cube. The L* axis runs from top to bottom. The maximum for L* is 100, which represents a perfect reflecting diffuser or white. The minimum for L* is 0, which represents black. As used herein, "white" means L* values of 80 or more.

In a preferred embodiment, the heat emissivity coefficient of the coating layer is greater than or equal to 0.5, more preferably greater than 0.7, most preferably greater than about 0.8. In yet another preferred embodiment, the absorptivity coefficient of the coating layer is greater than about 0.3, preferably greater than about 0.4, and most preferably greater than about 0.5. Because conductor coatings tends to crack due to thermal expansion of the wire during heating and cooling, the coefficient of expansion of the surface coating preferably matches that of the cable conductor. For the present invention, the coefficient of expansion of the coating is preferably in the range of $10\times10^{-6}$ to about $100\times10^{-6}$/° C., over a temperature range of 0-250° C. The coating layer preferably also passes heat aging characteristics. Since the overhead conductors are designed to operate at maximum temperatures of 75° C. to 250° C. depending on the design of the overhead conductor, accelerated heat aging is preferably carried out by placing the samples in an air circulating oven maintained at 325° C. for a period of 1 day and 7 days. After the thermal aging is complete, the samples are placed at room temperature of 21° C. for a period of 24 hours. The samples are then bent on different cylindrical mandrels sized from higher diameter to lower diameter; and the coatings are observed for any visible cracks at each of the mandrel size. Results are compared with the flexibility of the coating prior to thermal aging.

In another embodiment, the coating layer (coating composition) of the present invention includes a binder and a heat radiating agent. The composition, when coated on a bare conductor wire as a surface layer allows the conductor to better dissipate heat generated by the conductor during operation. The composition can also include other optional ingredients, such as fillers, stabilizers, colorants, surfactants and infrared (IR) reflective additives. The composition preferably contains only inorganic ingredients. If any organic ingredients are used, they should be less than about 10% (by weight of the dry coating composition), preferably less than 5 wt %. Once coated onto a conductor and dried, the coating layer is preferably less than 200 microns, more preferably less than 100 microns, most preferably less than 30 microns. But in any event, the thickness is at least 5 microns. The coatings produced in accordance with the present invention are preferably non-white. More preferably, the coatings are non-white (L*<80) and/or have an absorptivity of more than about 0.3, preferably about 0.5, most preferably about 0.7. The coatings can be electrically non-conductive, semi-conductive, or conductive.

One or more binders can be used in the coating composition, preferably at a concentration of about 20-60% (by weight of the total dry composition). The binder can contain a functional group, such as hydroxyl, epoxy, amine, acid, cyanate, silicate, silicate ester, ether, carbonate, maleic, etc. Inorganic binders can be, but are not limited to, metal silicates, such as potassium silicate, sodium silicate, lithium silicate and magnesium aluminum silicate; peptized aluminum oxide monohydrate; colloidal silica; colloidal alumina; aluminum phosphate and combinations thereof.

One or more heat radiating agents can be used in the coating composition, preferably at a concentration of about 1-20% (by weight of the total dry composition). The heat radiating agents include, but are not limited to, gallium oxide, cerium oxide, zirconium oxide, silicon hexaboride, carbon tetraboride, silicon tetraboride, silicon carbide, molybdenum disilicide, tungsten disilicide, zirconium diboride, zinc oxide, cupric chromite, magnesium oxide, silicon dioxide, manganese oxide, chromium oxides, iron oxide, boron carbide, boron silicide, copper chromium oxide, tricalcium phosphate, titanium dioxide, aluminum nitride, boron nitride, alumina, magnesium oxide, calcium oxide, and combinations thereof.

One or more IR reflective additives may be used in the coating composition. Generally, IR reflective additives can include, but are not limited to, cobalt, aluminum, bismuth, lanthanum, lithium, magnesium, neodymium, niobium, vanadium, ferrous, chromium, zinc, titanium, manganese, and nickel based metal oxides and ceramics. Typically the IR reflective additives are used at 0.1 to 5% (by weight of the total dry composition) either individually or mixed with colorants.

One or more stabilizers may be used in the coating composition, preferably at a concentration of about 0.1 to 2% (by weight of the total dry composition). Examples of stabilizers include, but are not limited to, dispersion stabilizer, such as bentonites.

One or more colorants may be used in the coating composition, preferably at a concentration of about 0.02 to 0.2% (by weight of the total dry composition). The colorant can be organic or inorganic pigments, which includes, but are not limited to, titanium dioxide, rutile, titanium, anatine, brookite, cadmium yellow, cadmium red, cadmium green, orange cobalt, cobalt blue, cerulean blue, aureolin, cobalt yellow, copper pigments, azurite, Han purple, Han blue, Egyptian blue, malachite, Paris green, phthalocyanine blue BN, phthalocyanine green G, verdigris, viridian, iron oxide pigments, sanguine, caput mortuum, oxide red, red ochre, Venetian red, Prussian blue, clay earth pigments, yellow ochre, raw sienna, burnt sienna, raw umber, burnt umber, marine pigments (ultramarine, ultramarine green shade), zinc pigments (zinc white, zinc ferrite), and combinations thereof.

One or more surfactants may also be used in the coating composition, preferably at a concentration of about 0.05-0.5% (by weight of the total dry composition). Suitable surfactants include, but are not limited to, cationic, anionic, or non-ionic surfactants, and fatty acid salts.

Other coatings appropriate for the present invention are found in U.S. Pat. No. 6,007,873 to Holcombe Jr. et al., U.S. Pat. No. 7,105,047 to Simmons et al., and U.S. Pat. No. 5,296,288 to Kourtides et al., which are incorporated herein by reference.

A preferred coating composition contains 51.6 weight percent cerium oxide powder and 48.4 weight percent of an aluminum phosphate binder solution. The aluminum phosphate binder solution preferably contains 57 weight percent mono aluminum phosphate trihydrate ($Al(H_2\ PO_4)_3$), 2 weight percent phosphoric acid, and 41 weight percent water.

Another preferred coating composition contains boron carbide or boron silicide as an emissivity agent and a binder solution. The binder solution contains a mixture of sodium silicate and silicon dioxide in water, with the dry weight ratio in the coating of sodium silicate to silicon dioxide being about 1:5. The loading of the boron carbide is such that it constitutes 2.5 wt %-7.5 wt % of the total coating dry weight.

Yet another preferred coating composition contains colloidal silicon dioxide as the binder and silicon hexaboride powder as the emissivity agent. The loading of the silicon hexaboride is such that it constitutes 2.5 wt %-7.5 wt % of the total coating dry weight.

In an embodiment of the present invention, the coating composition may contain less than about 5% of organic material. In that case, the coating composition preferably contains sodium silicate, aluminum nitride, and an amino functional siloxane (silicone modified to contain amino functional group(s)). The sodium silicate is preferably present at about 60-90 wt % of the dry coating composition, more preferably about 67.5-82.5 wt %; the aluminum nitride is preferably present at about 10-35 wt % of the dry coating composition, more preferably 15-30 wt %; and the amino functional siloxane is preferably present at about less than about 5 wt % of the dry coating composition, more preferably about 2-3 wt %. The aluminum nitride preferably has a specific surface area of less than 2 $m^2/g$ and/or the following particle size distribution: D 10%—0.4-1.4 microns, D 50%—7-11 microns, and D 90% 17-32 microns. The preferred amino functional siloxane is amino dimethylpolysiloxane. More preferably the dimethylpolysiloxane has a viscosity of about 10-50 centistokes at 25° C. and/or an amine equivalent of 0.48 milliequivalents of base/gram.

Once cured, the coating offers a flexible coating that shows no visible cracks when bent on a mandrel of diameter of 10 inches or less. The cured coating is also heat resistant and passes the same mandrel bent test after heat aging at 325° C. for a period of 1 day and 7 days.

FIGS. 1, 2, 3, and 4 illustrate various bare overhead conductors according to various embodiments of the invention incorporating a spectrally selective surface.

Figure 2:
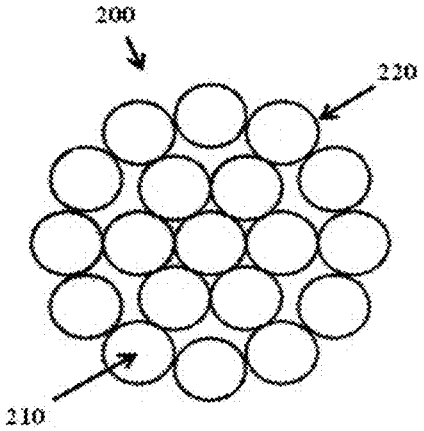
FIG. 2 is a cross sectional view of a conductor in accordance with one embodiment of the present invention.
Figure 3:
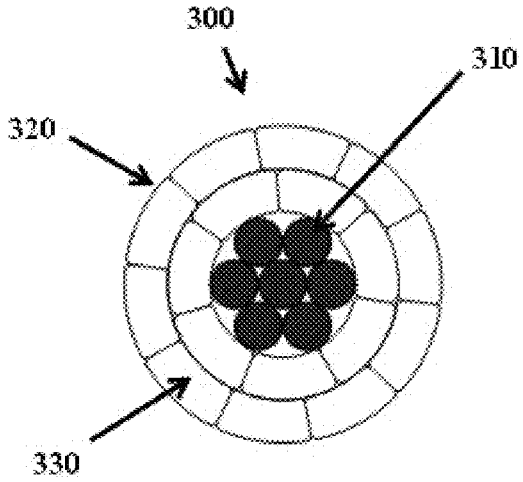
FIG. 3 is a cross sectional view of a conductor in accordance with one embodiment of the present invention.

As seen in FIG. 1, the bare overhead conductor 100 of the present invention generally includes a core of one or more wires 110, round-cross section conductive wires around the core 120, and the spectrally selective surface layer 130. The core 110 may be steel, invar steel, carbon fiber composite, or any other material providing strength to the conductor. The conductive wires 120 are copper, or a copper alloy, or an aluminum or aluminum alloy, including aluminum types 1350, 6000 series alloy aluminum, or aluminum-zirconium alloy, or any other conductive metal. As seen in FIG. 2, the bare overhead conductor 200 generally includes round conductive wires 210 and the spectrally selective surface layer 220. The conductive wires 210 are copper, or a copper alloy, or an aluminum or aluminum alloy, including aluminum types 1350, 6000 series alloy aluminum, or aluminum-zirconium alloy, or any other conductive metal. As seen in FIG. 3, the bare overhead conductor 300 of the present invention generally includes a core of one or more wires 310, trapezoidal shaped conductive wires around the core 320, and the spectrally selective surface layer 330. The core 310 may be steel, invar steel, carbon fiber composite, or any other material providing strength to the conductor. The conductive wires 320 are copper, or a copper alloy, or an aluminum or aluminum alloy, including aluminum types 1350, 6000 series alloy aluminum, or aluminum-zirconium alloy, or any other conductive metal.

Figure 4:
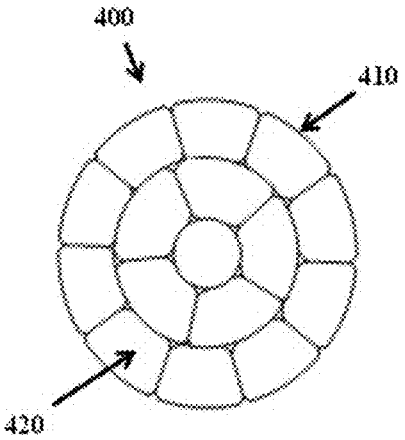
FIG. 4 is a cross sectional view of a conductor in accordance with one embodiment of the present invention.

As seen in FIG. 4, the bare overhead conductor 400 generally includes trapezoidal shaped conductive wires 410 and the spectrally selective surface layer 420. The conductive wires 410 are copper, or a copper alloy, or an aluminum or aluminum alloy, including aluminum types 1350, 6000 series alloy aluminum, or aluminum-zirconium alloy, or any other conductive metal.

The coating composition can be made in a High Speed Disperser (HSD), Ball Mill, Bead mill or using other techniques known in the art. In a preferred embodiment, a HSD is used to make the coating composition. To make the coating composition, the binders, dispersion medium and surfactant (if used) are taken in a High Speed Disperser and a solution is prepared. Into that solution, the heat radiating agent, fillers, stabilizers, colorants and others additives are slowly added. Initially, a lower stirrer speed is used to remove the entrapped air and afterwards the speed is increased gradually up to 3000 rpm. The high speed mixing is performed until the desired dispersion of the fillers and other additives is achieved in the coating. Any porous fillers may also be pre-coated with the binder solution prior to their addition into the mixture. The dispersion medium can be water or an organic solvent. Examples of organic solvents include, but are not limited to, alcohols, ketones, esters, hydrocarbons, and combinations thereof. The preferred dispersion medium is water. The resulting coating mixture is a suspension with a total solid content of about 40-80%. Upon storage of this mixture, the solid particles may settle, and hence, that coating mixture needs to be stirred and may further be diluted to achieve the required viscosity before transferring in to the coating applicator.

In an embodiment of the present invention, the surface of the overhead conductor is prepared prior to the application of the coating composition. The preparation process can be chemical treatment, pressurized air cleaning, hot water or steam cleaning, brush cleaning, heat treatment, sand blasting, ultrasound, deglaring, solvent wipe, plasma treatment, and the like. In a preferred process, the surface of the overhead conductor is deglared by sand blasting The coating mixture composition can be applied by spray gun, preferably with 10-45 psi pressure, which is controlled through the air pressure. The spray gun nozzle is preferably placed perpendicular to the direction of the conductor (at approximately 90° angle) to get a uniform coating on conductor product. In specific cases, two or more guns can be used to get more efficient coatings. The coating thickness and density are controlled by the admixture viscosity, gun pressure, and conductor line speed. During the coating application, the overhead conductor temperature is preferably maintained between 10° C. to 90° C. depending on the material of the conductor.

Alternatively, the coating mixture can be applied to the overhead conductor by dipping or using a brush or using a roller. Here, the cleaned and dried conductor is dipped into the coating mixture to allow the mixture to completely coat the conductor. The conductor is then removed from the coating mixture and allowed to dry.

After application, the coating on the overhead conductor is allowed to dry by evaporation either at room temperature or at elevated temperatures up to 325° C. In an embodiment, the coating is dried by direct flame exposure which exposes the coating to intense, but brief (about 0.1-2 seconds, preferably about 0.5-1 second) heating.

The developed coating can be used for overhead conductors which are already installed and currently being used. Existing conductors can be coated with a robotic system for automated or semi-automated coating. The automated system functions in three steps: 1. cleaning the conductor surface; 2. applying the coating on the conductor surface; and 3. drying the coating.

The coating can be applied to the conductors in several ways. It can be applied by coating the individual wires before their assembly in the bare overhead conductor. Here, it is possible to have all of the wires of the conductor coated, or more economically, only the outer most wires of the conductor coated. Alternatively, the coating can be applied only to the outer surface of the bare overhead conductor. Here, the complete outer surface or a portion thereof can be coated.

Figure 10:
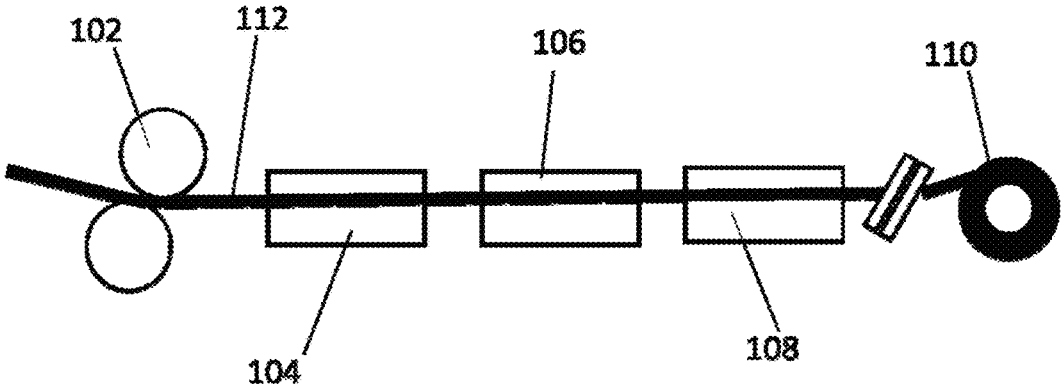
FIG. 10 is a drawing showing a continuous process of the present invention.

The coating can be applied in a batch process, a semi-batch process, or a continuous process. The continuous process is preferred. FIG. 10 illustrates a preferred continuous process for the present invention. After the intake winding roll 102, the conductor 112 is passed through a surface preparation process via a pretreatment unit 104 prior to the coating being applied in the coating unit 106. After the coating is applied, the conductor may be dried via a drying/curing unit 108. Once dried, the cable is wound on a roller 110.

In the pretreatment unit 104, the surface of the conductor 112, is preferably prepared by media blasting. The preferred media is sand, however, glass beads, ilmenite, steel shot, could also be used. The media blasting is followed by air-wiping to blow the particulate materials off the conductor 112. An air-wipe consists of jets of air blown on to the conductor 112 at an angle and in a direction opposing the direction of travel of the conductor 112. The air jets create a 360° ring of air that attaches to the circumference of the conductor 112 and wipes the surface with the high velocity of air. In this case, as the conductor exits the pretreatment unit 104, any particles on the conductor 112 are wiped and blown back into the pretreatment unit 104. The air jet typically operates at about 60 to about 100 PSI, preferably about 70-90 PSI, more preferably about 80 PSI. The air jet preferably has a velocity (coming out of the nozzles) of about 125 mph to about 500 mph, more preferably about 150 mph to about 400 mph, and most preferably about 250 mph to about 350 mph. After the air-wipe, number of particles, that are greater than 10 microns in size, on the surface of the conductor are lower than 1,000 per square feet of the conductor surface, preferably less than 100 per square feet of the surface. After the air wipe, the conductor is preferably heated, e.g. by a heating oven, UV, IR, E-beam, open flame, and the like. The heating can be accomplished by single or multiple units. In a preferred embodiment, the drying/curing occurs by direct flame application. Here, the cable is passed directly through a flame to heat the cable surface to a temperature above ambient temperature. High heating temperature in pretreatment allows for a lower heating temperature later in the drying/curing unit. However, the heating should not be too severe that it affects the quality of the coating (e.g. adherence, evenness, blistering etc.). Here, it is preferable that the conductor not be heated above about 140° C., more preferably no more than about 120° C.

Figure 11:
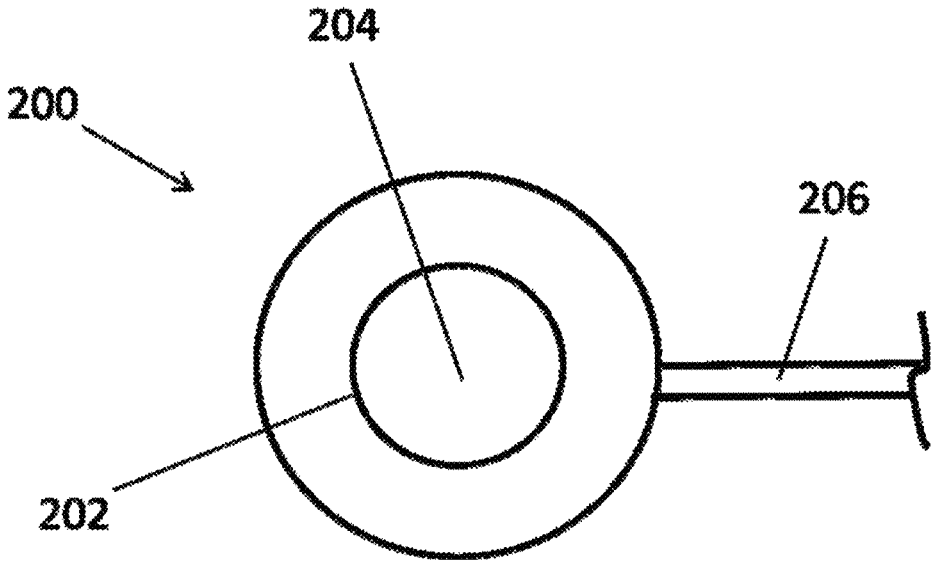
FIG. 11 is drawing showing a cross-section of the flooded die.
Figure 12:
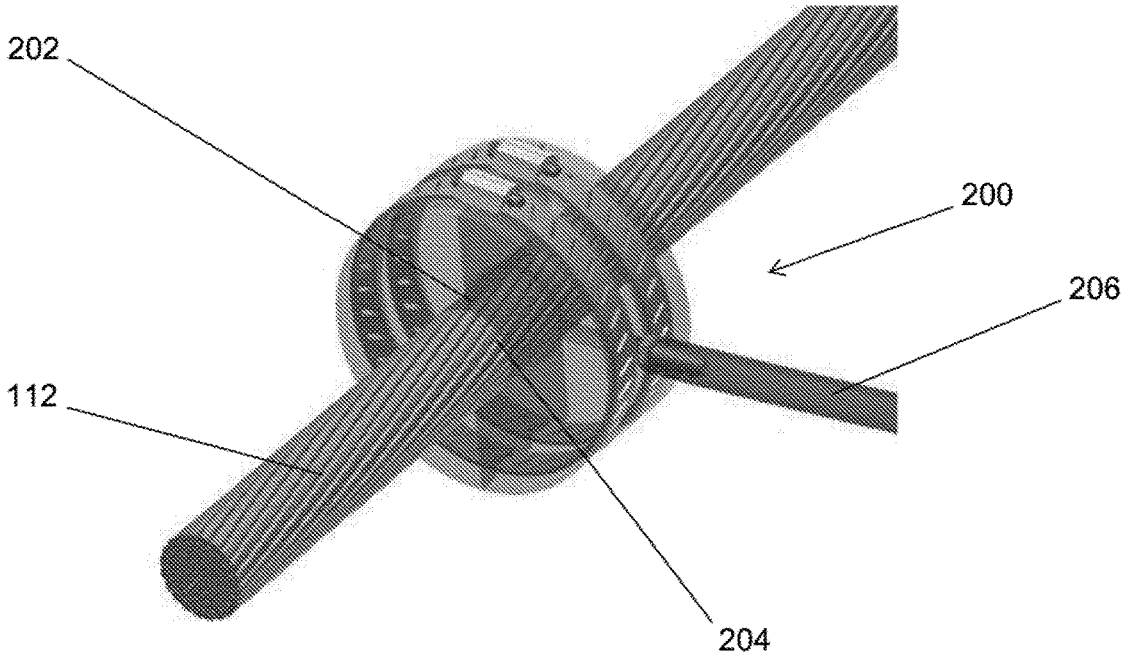
FIG. 12 is a drawing showing a plan view of the flooded die.
Figure 13:
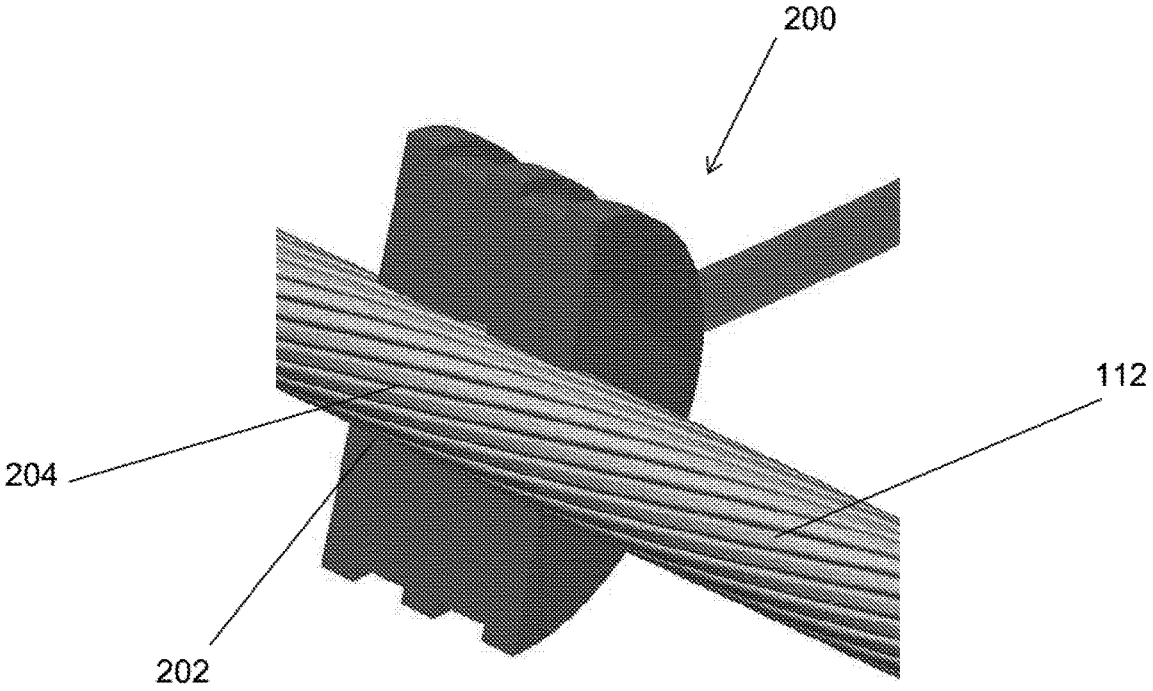
FIG. 13 is a drawing showing a cut-away view of the flooded die.

Once the surface of the conductor 112 is prepared, it is ready for coating. The coating process takes place in the coating unit, where the cable passes through a flooded die that deposits a liquid suspension of the coating onto the prepared surface. FIGS. 11-13 show a depiction of an annular shaped flooded die 200. The coating suspension is fed to the die 200 via a tube 206. As the conductor 112 passes though the center opening 204 of the flooded die 200, the coating suspension coats the conductor 112 via opening ports in the inner surface 202 of the die 200. Preferably, the flooded die 200 contains two or more, preferably four, more preferably six, opening ports evenly spaced around the circumference of the inner surface 202. Once the conductor 112 exits the flooded die, it then passes through another air wipe to remove excess coating suspension and to spread the coating evenly around the conductor. In the case of a stranded conductor, the air wipe allows the coating to penetrate the grooves between the strands on the surface of the conductor. This air wipe preferably operates at the same condition as that for the air wipe in the pretreatment unit 104.

Once the conductor 112 is coated, it passes through the drying/curing unit 108. The drying/curing can be accomplished by air or by using hot air of the temperature of up to 1000° C. and/or the line speed of between about 9 feet/min to about 500 feet/min, preferably about 10 feet/min to about 400 feet/min, depending on the metal alloy used in the conductor. The drying process may be gradual drying, rapid drying, or direct flame application. The drying or curing also can be accomplished by other techniques, like a heating oven, UV, IR, E-beam, chemical, or liquid spray and the like. The drying can be accomplished by single or multiple units. It also can be vertical or horizontal or at a specific angle. In a preferred embodiment, the drying/curing occurs by direct flame application. Here, the cable preferably passes directly through a flame to heat the cable surface to a temperature of up to about 150° C., preferably up to about 120° C. Once dried/cured, the coated conductor is wound on a roller 110 for storage.

The continuous process, if operated for an individual strand (instead of the whole cable), preferably operates at a line speed of up to about 2500 ft/min, preferably about 9 to about 2000 ft/min, more preferably about 10 to about 500 ft/min, most preferably about 30 to about 300 ft/min.

The overhead conductor coating of the present invention can be used in composite core conductor designs. Composite core conductors are used due to their lower sag at higher operating temperatures and higher strength to weight ratio. Reduced conductor operating temperatures due to the coating can further lower sag of the conductors and lower degradation of polymer resin in the composite. Examples for composite cores can be found, e.g., in U.S. Pat. Nos. 7,015,395, 7,438,971, and 7,752,754, which are incorporated herein by reference.

The coated conductor exhibits improved heat dissipation. Emissivity is the relative power of a surface to emit heat by radiation, and the ratio of the radiant energy emitted by a surface to the radiant energy emitted by a blackbody at the same temperature. Emittance is the energy radiated by the surface of a body per unit area. Emissivity can be measured, for example, by the method disclosed in U.S. Patent Application Publication No. 2010/0076719 to Lawry et al., which is incorporated herein by reference.

Without further description, it is believed that one of ordinary skill in the art can, using the preceding description and the following illustrative examples, make and utilize the compounds of the present invention and practice the claimed methods. The following example is given to illustrate the present invention. It should be understood that the invention is not to be limited to the specific conditions or details described in this example.

Example 1

Computer simulation studies was performed using different E/A (Emissivity to Absorptivity ratio) values, to measure the reduction in operating temperature of the conductor for the same peak current. The E/A ratios were considered as the surface property of the conductor which is modified by coating. Table 1 tabulates the simulation results for various designs of overhead conductor:

TABLE 1

| Simulation Results | | | | | | | | | |
|---|---|---|---|---|---|---|---|---|---|
| | Symbol | Units | Case 1 | Case 2 | Case 3 | Case 4 | Case 5 | Case 6 | Case 7 |
| Simulation 1: Rail ACSR | | | | | | | | | |
| E/A Ratio | | E/A | .5/.5 | .3/.3 | .9/.9 | .7/.5 | .8/.4 | .9/.3 | .9/.2 |
| Number conductors per bundle | | | 1 | 1 | 1 | 1 | 1 | 1 | 1 |
| Peak Current (per conductor) | I | amps | 970 | 970 | 970 | 970 | 970 | 970 | 970 |
| Sub-conductor temperature | Tc | ° C. | 74 | 75 | 73 | 70 | 67 | 64 | 63 |
| Sub-conductor Resistance at Tc | R | ohms/mile | 0.14 | 0.14 | 0.14 | 0.14 | 0.14 | 0.13 | 0.12 |
| Power Loss | PL | kW/mile | 115.37 | 115.60 | 115.03 | 113.92 | 112.68 | 111.52 | 111.03 |
| Simulation 2: Curlew ACSR | | | | | | | | | |
| E/A Ratio | | E/A | .5/.5 | .3/.3 | .9/.9 | .7/.5 | .8/.4 | .9/.3 | .9/.2 |
| Number conductors per bundle | | | 1 | 1 | 1 | 1 | 1 | 1 | 1 |
| Peak Current (per conductor) | I | amps | 1040 | 1040 | 1040 | 1040 | 1040 | 1040 | 1040 |
| Sub-conductor temperature | Tc | ° C. | 75 | 76 | 74 | 71 | 68 | 64 | 63 |
| Sub-conductor Resistance at Tc | R | ohms/mile | 0.11 | 0.11 | 0.11 | 0.11 | 0.11 | 0.11 | 0.11 |
| Power Loss | PL | kW/mile | 121.54 | 121.86 | 121.13 | 119.98 | 118.65 | 117.39 | 116.70 |
| Simulation 3: Lapwing ACSR | | | | | | | | | |
| E/A Ratio | | E/A | .5/.5 | .3/.3 | .9/.9 | .7/.5 | .8/.4 | .9/.3 | .9/.2 |
| Number conductors per bundle | | | 1 | 1 | 1 | 1 | 1 | 1 | 1 |
| Peak Current (per conductor) | I | amps | 1335 | 1335 | 1335 | 1335 | 1335 | 1335 | 1335 |
| Sub-conductor temperature | Tc | ° C. | 75 | 76 | 74 | 71 | 67 | 64 | 62 |
| Sub-conductor Resistance at Tc | R | ohms/mile | 0.08 | 0.08 | 0.08 | 0.07 | 0.07 | 0.07 | 0.07 |
| Power Loss | PL | kW/mile | 134.28 | 134.63 | 133.83 | 132.55 | 131.08 | 129.71 | 129.03 |
| Simulation 4: Bluebird ACSR | | | | | | | | | |
| E/A Ratio | | E/A | .5/.5 | .3/.3 | .9/.9 | .7/.5 | .8/.4 | .9/.3 | .9/.2 |
| Number conductors per bundle | | | 1 | 1 | 1 | 1 | 1 | 1 | 1 |
| Peak Current (per conductor) | I | amps | 1620 | 1620 | 1620 | 1620 | 1620 | 1620 | 1620 |
| Sub-conductor temperature | Tc | ° C. | 75 | 76 | 74 | 70 | 67 | 63 | 61 |
| Sub-conductor Resistance at Tc | R | ohms/mile | 0.06 | 0.06 | 0.06 | 0.05 | 0.05 | 0.05 | 0.05 |
| Power Loss | PL | kW/mile | 145.76 | 146.11 | 145.28 | 143.87 | 142.32 | 140.87 | 140.14 |
| Simulation 5: Drake ACSR | | | | | | | | | |
| E/A Ratio | | E/A | .5/.5 | .3/.3 | .9/.9 | .7/.5 | .8/.4 | .9/.3 | .9/.2 |
| Number conductors per bundle | | | 1 | 1 | 1 | 1 | 1 | 1 | 1 |
| Peak Current (per conductor) | I | amps | 900 | 900 | 900 | 900 | 900 | 900 | 900 |
| Sub-conductor temperature | Tc | ° C. | 74 | 75 | 73 | 70 | 67 | 64 | 62 |
| Sub-conductor Resistance at Tc | R | ohms/mile | 0.14 | 0.14 | 0.14 | 0.14 | 0.14 | 0.13 | 0.13 |
| Power Loss | PL | kW/mile | 112.42 | 112.63 | 112.07 | 110.97 | 109.79 | 108.66 | 108.05 |

Other conditions Ambient Temperature: 25° C., Wind Speed: 2 ft/s

Example 2

Figure 5:
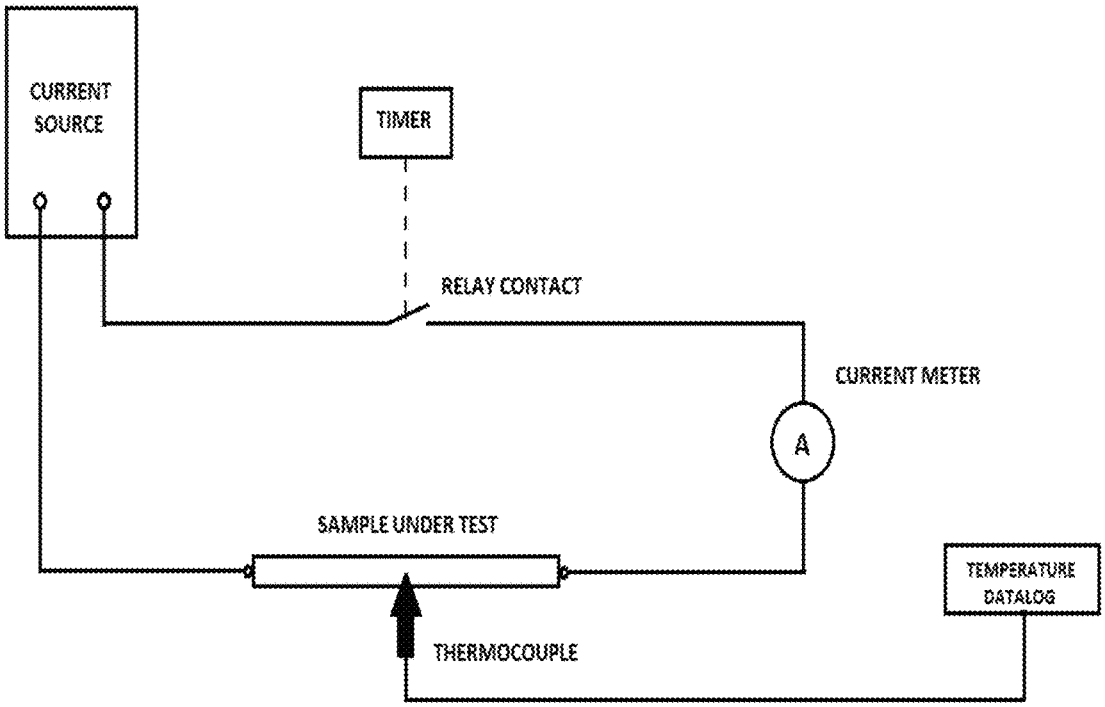
FIG. 5 is a drawing showing the test arrangement to measure the temperature of metal substrates for a given applied current.

A coating was prepared by mixing Sodium silicate (20 weight %), Silicon dioxide (37 weight %) with Boron Carbide as a heat radiating agent (3 weight %) and Water (40 weight %). The coating composition is applied to a metal substrate having an emissivity of higher than 0.85. A current is applied through the metal substrate with a 1 mil coating thickness and an uncoated metal substrate to measure the performance improvement of the coating. The test apparatus is shown in FIG. 5 and mainly consisted of a 60 Hz ac current source, a true RMS clamp-on current meter, a temperature datalog device and a timer. Testing was conducted within a 68" wide×33" deep windowed safety enclosure to control air movement around the sample. An exhaust hood was located 64" above the test apparatus for ventilation.

The sample to be tested was connected in series with an ac current source through a relay contact controlled by a timer. The timer was used to activate the current source and controlled the time duration of the test. The 60 Hz ac current flowing through the sample was monitored by a true RMS clamp-on current meter. A thermocouple was used to measure the surface temperature of the sample. Using a spring clamp, the tip of the thermocouple was kept firmly in contacted with the center surface of the sample. In case of measurement on coated sample, the coating was removed at the area where thermocouple made the contact with the sample to get accurate measurement of the temperature of the substrate. The thermocouple temperature was monitored by a datalog recording device to provide a continuous record of temperature change.

Both uncoated and coated substrate samples were tested for temperature rise on this test set-up under identical experimental conditions. The current was set at a desired level and was monitored during the test to ensure a constant current is flowing through the samples. The timer was set at a desired value and the temperature datalog recording device was set to record temperature at a recording interval of one reading per second.

The metal component for the uncoated and coated samples was from the same source material and lot of Aluminum 1350. The finished dimensions of the uncoated sample were 12.0"(L)×0.50"(W)×0.027"(T). The finished dimensions of the coated samples were 12.0"(L)×0.50"(W)×0.029"(T). The increase in thickness and width was due to the thickness of the applied coating.

The uncoated sample was firmly placed into the test set-up and the thermocouple secured to the center portion of the sample. Once that was completed, the current source was switched on and was adjusted to the required ampacity load level. Once that was achieved the power was switched off. For the test itself, once the timer and datalog device were all properly set, the timer was turned on to activate the current source, thus, starting the test. The desired current flowed through the sample and the temperature started rising. The surface temperature change of the sample was automatically recorded by the datalog device. Once the testing period was completed, the timer automatically shut down the current source, thus, ending the test.

Once the uncoated sample was tested, it was removed from the set-up and replaced by the coated sample. The testing resumed, making no adjustments to the power supply current device. The same current level was passed through the coated sample.

Figure 6:
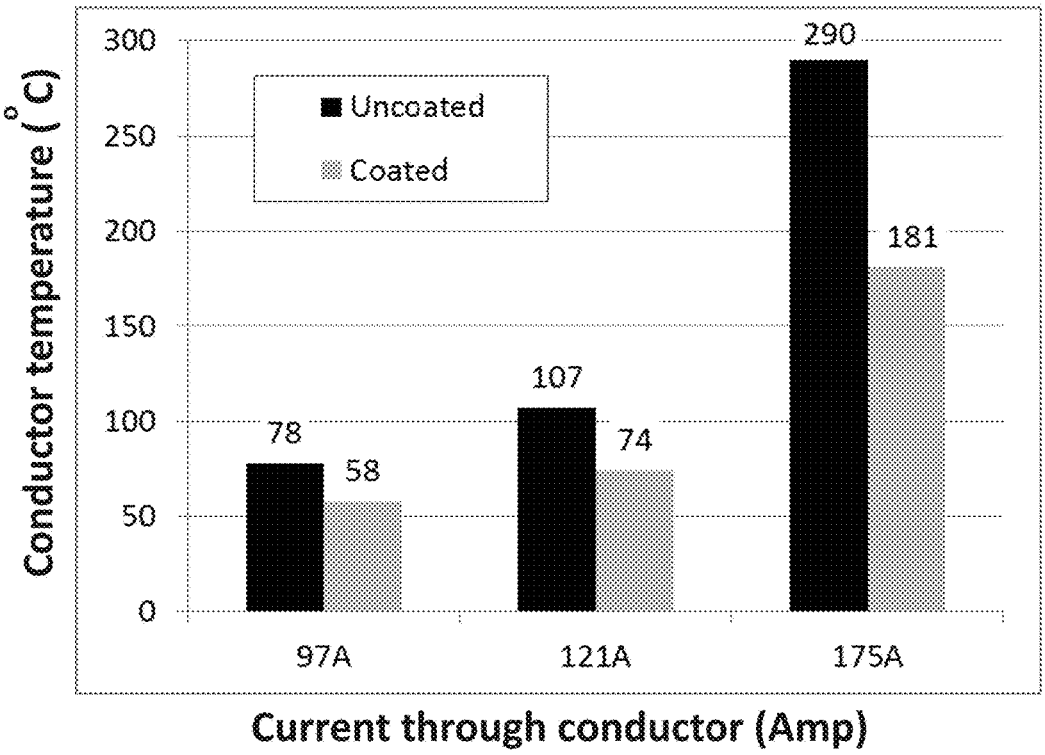
FIG. 6 is a graph showing the temperatures of coated and uncoated conductors.

The temperature test data was then accessed from the datalog device and analyzed using a computer. Comparing the results from the uncoated sample tests with those from the coated tests was used to determine the comparative emissivity effectiveness of the coating material. The results of the test are shown in FIG. 6.

Example 3

Wind effects on temperature rise of the two #4 AWG solid aluminum coated conductors were evaluated at a current of 180 amps. A fan with three speeds was used to simulate the wind and the wind blew directly to the conductor being tested from 2 feet away. The test method circuit diagram is showed in FIG. 7. Both coated and uncoated conductors were tested under 180 amps, solar light, and wind; and the test results are shown in Table 2. The coated conductor was 35.6%, 34.7% and 26.1% cooler than the uncoated when subjected to no wind, low wind, and high wind, respectively. The speed of the wind had a little impact on the coated conductor but a 13% impact on the uncoated.

TABLE 2

Wind effect on coated and uncoated conductor's temperature at 180 amps.

| | Temperature Rise (° C.) | | | |
|---|---|---|---|---|
| 180 amps | Uncoated | Coated | Difference | Difference (%) |
| No Wind | 174 | 112 | 62 | 35.6 |
| Low Wind | 101 | 66 | 35 | 34.7 |
| High Wind | 88 | 65 | 23 | 26.1 |

Wind effects on temperature rise of the two #4 AWG solid aluminum conductors were evaluated at 130 amps current. The uncoated and coated conductors were tested under no wind, low wind and high wind, respectively, along with 130 amps current and solar light. The tests results are summarized in Table 3. The coated conductor was 29.9%, 13.3% and 17.5% cooler than the uncoated conductor when subjected to no wind, low wind and high wind respectively.

TABLE 3

Wind effect on coated and uncoated conductor's temperature at 130 amps

| | Temperature Rise (° C.) | | | |
|---|---|---|---|---|
| 130 amps | Uncoated | Coated | Difference | Difference (%) |
| No Wind | 108 | 76 | 32 | 29.9 |
| Low Wind | 60 | 52 | 8 | 13.3 |
| High Wind | 57 | 47 | 10 | 17.5 |

Example 4

Tests were performed on coated and uncoated 2/0 AWG solid aluminium and 795 kcmil AAC Arbutus conductor samples. The Current Cycle Test method was performed in accordance with ANSI C119.4-2004 as adapted herein.

Conductor Test Samples:

1) 2/0 AWG Solid Aluminum Conductor coated with coating composition disclosed in Example 2. Thickness of the coating is 1 mil.

2) Uncoated 2/0 AWG Solid Aluminum Conductor 3) 795 kcmil Arbutus All-Aluminum Conductor coated with coating composition disclosed in Example 2. Thickness of the coating is 1 mil.

4) Uncoated 795 kcmil Arbutus All-Aluminum Conductor

5) Aluminum Plate (electrical grade bus)

Figure 7:
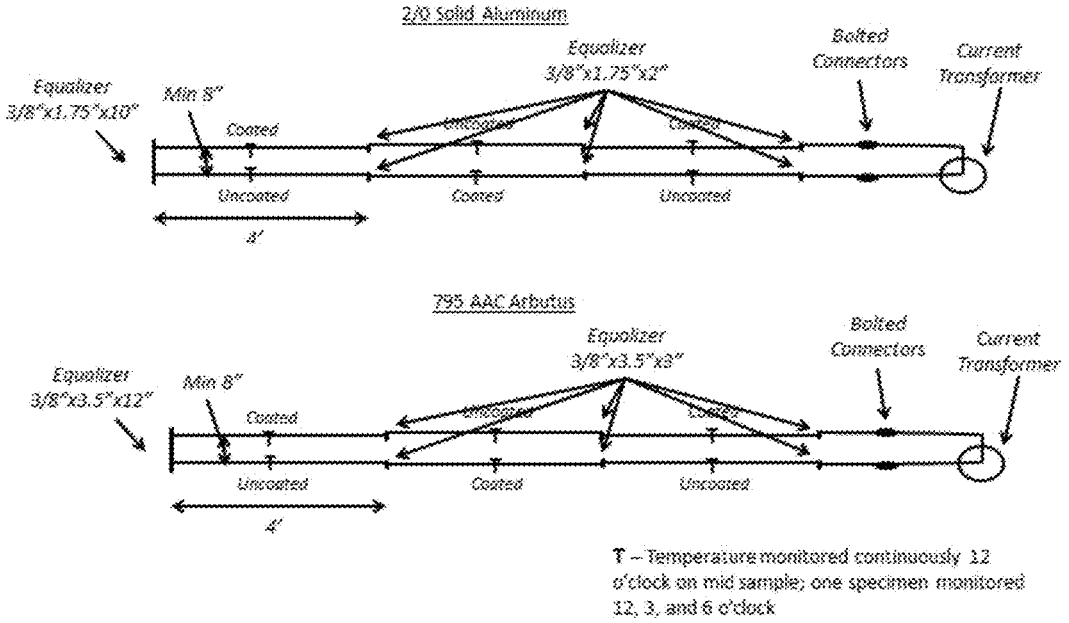
FIG. 7 is a drawing showing the test arrangement to measure the temperature difference of metal substrates in series loop system for a given applied current.

TEST LOOP ASSEMBLY: A series loop was formed with six identically sized four foot conductor specimens (three uncoated and three coated), plus an additional suitable conductor routed through the current transformer. The series loop consisted of two runs of three identically sized conductor specimens, alternating between coated and uncoated, welded together with an equalizer installed between conductor specimens to provide equipotential planes for resistance measurements. The equalizers ensured permanent contacts between all conductor strands. Equalizers (2"×⅜"×1.75" for 2/0 solid aluminum and 3"×⅜"×3.5" for 795 AAC Arbutus) were fabricated from aluminum bus. Holes the size of the connecting conductor were drilled into the equalizers. Adjacent conductor ends were welded to the equalizers to complete the series loop. A larger equalizer (10"×⅜"×1.75" for 2/0 solid aluminium and 12"×⅜"×3.5" for 795 AAC Arbutus) was used at one end to connect the two runs, while the other end was connected to an additional conductor routed through the current transformer. The loop configuration is depicted in FIG. 7.

The test loop assembly was located at least 1 ft. from any wall and at least 2 ft. from the floor and ceiling. Adjacent loops were located at least 1 ft. from each other and were energized separately.

TEMPERATURE MEASUREMENT: The temperature of each conductor specimen was monitored simultaneously at specified intervals over the course of the test. The temperature was monitored using Type T thermocouples and a Data Logger. One thermocouple was attached to the each conductor at midpoint on the specimen in the 12 o'clock position. One specimen of each sample had additional thermocouples connected to the sides of the specimen at the 3 and 6 o'clock positions. One thermocouple was located adjacent to the series loop for ambient temperature measurements.

CURRENT SETTING: The conductor current was set at appropriate ampacity to produce a temperature of 100° C. to 105° C. above ambient air temperature at the end of a heating period for the uncoated conductor specimen. Since the uncoated conductor and the coated conductor were placed in series in the test assembly, the same current passed through both samples. The first few heat cycles were used to set the proper ampacity to produce the desired temperature rise. A heat cycle consisted of one hour of heating followed by one hour of cooling for the 2/0 AWG solid aluminium loop, and one and a half hours of heating followed by one and a half hours of cooling for the 795 stranded aluminium loop.

TEST PROCEDURE: The test was conducted in accordance with the Current Cycle Test Method, ANSI C119.4-2004, except that the test was performed for a reduced number of heat cycles (at least fifty cycles were performed). Ambient temperature was maintained at ±2° C. Temperature measurements were recorded continuously during the heat cycles. Resistance was measured at the end of the heating cycle and prior to the next heating cycle, after the conductor returned to room temperature.

Figure 8:
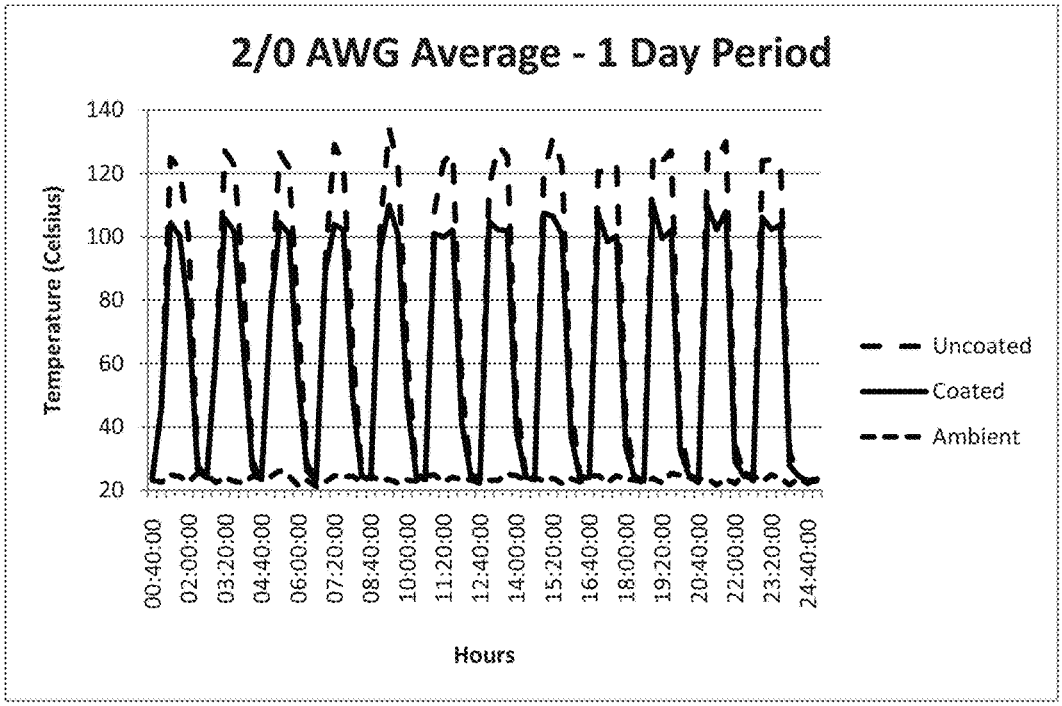
FIG. 8 is a graph showing temperatures of 2/0 AWG Solid Aluminum Conductors.
Figure 9:
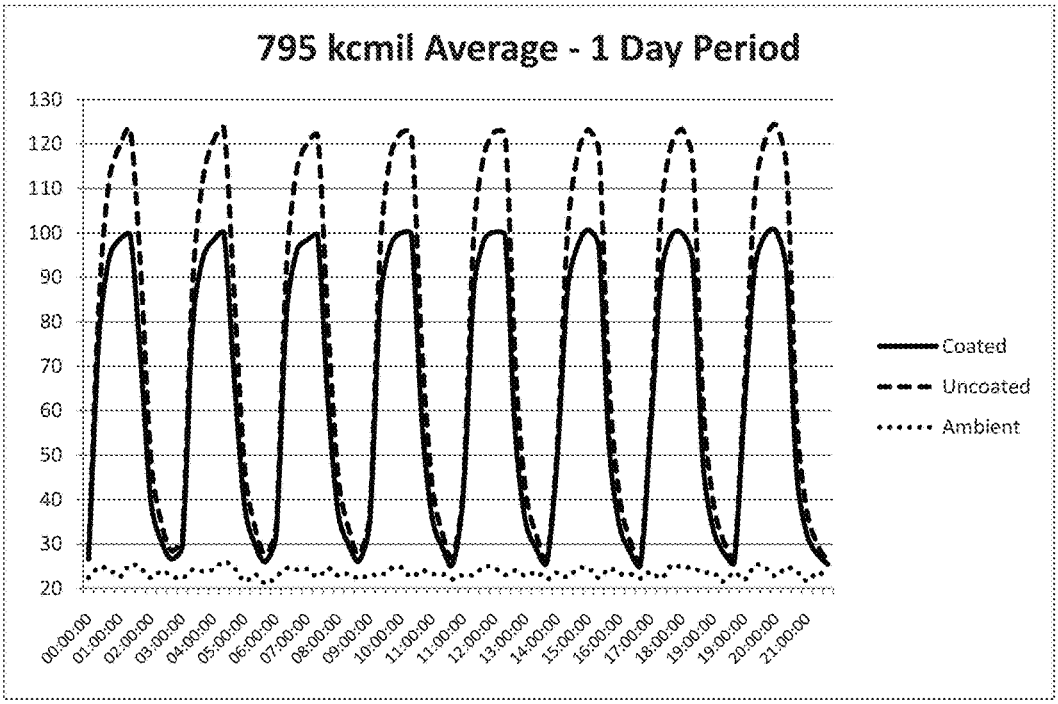
FIG. 9 is a graph showing temperatures of 795 kcmil Arbutus All-Aluminum Conductors.

TEST RESULT: The coated 2/0 AWG Solid Aluminium Conductor and 795 kcmil Arbutus All-Aluminium Conductor showed lower temperatures (more than 20° C.) than the uncoated conductors. The temperature difference data were captured in FIG. 8 and FIG. 9, respectively.

Example 5

An aluminum substrate was coated with various coating compositions as described below and summarized in Table 4. The coating compositions have a color spectrum ranging from white to black.

Aluminum Control: Uncoated aluminum substrate made from 1350 Aluminum Alloy.

Coating 2: Polyurethane based coating having solids content of 56 weight %, available from Lord Corporation as grade Aeroglaze A276.

Coating 3: PVDF based coating with Fluoropolymer/Acrylic resin ratio of 70:30 available from Arkema as Kynar ARC and 10 weight % of Titanium dioxide powder.

Coating 4: Coating containing of 75 weight % of Sodium silicate solution in water (containing 40% solid) and 25 weight % of Zinc oxide available from US Zinc.

Coating 5: Coating containing 72.5 weight % of Sodium silicate solution in water (containing 40% solid) and 12.5 weight % of Aluminum Nitride AT powder (having particle size distribution of D 10% 0.4 to 1.4 microns, D 50% 7 to 11 microns, D 90% 17 to 32 microns) available from H. C. Starck, 12.5 weight % of Silicon carbide and 2.5 weight % of reactive amino silicone resin (grade SF1706) available from Momentive Performance Material holding Inc.

Coating 6: Coating containing 87.5 weight % of Silicone based coating (Grade 236) available from Dow corning and 12.5 weight % of Silicon carbide.

Coating 7: Coating containing Silicate binder (20 weight %), Silicon dioxide (37 weight %) and Boron Carbide (3 weight %) and Water (40 weight %)

Coating 8: Coating containing Potassium silicate (30 weight %), Tri Calcium Phosphate (20% weight %), Mixed metal oxide pigment (5%) and Water (45%)

Color of the samples was measured on the L*, a*, b* scale using Spectro-guide 45/0 gloss made by BYK-Gardner USA.

Samples were tested for Solar Reflectance (R) and Absorptivity (A) as per ASTM E903. Emissivity (E) of the samples was measured as per ASTM E408 at the temperature of 300K. The aluminum substrate of 50 mm length×50 mm width×2 mm thickness coated with 1 mil thickness coating were used for the measurements of Solar Reflectance, Absorptivity, Emissivity.

The coated samples were tested for their ability to reduce operating temperature of the conductor when compared to a bare aluminum substrate as described in Example 2 using electrical current setting of 95 amps. To study the effect of Solar energy on the operating temperature of the conductor, light bulb simulating Solar energy spectrum was placed above the test sample in addition to the electrical current applied to the test sample and the test sample temperature was recorded. Standard Metal Halide 400 Watt Bulb (Model MH400/T15/HOR/4K) was used. Distance between the lamp and the bulb was maintained at 1 ft. The results are tabulated as "Electrical+Solar". Results with the light bulb turned off while electrical current turned on are tabulated as "Electrical".

Heat aging performance of the coating was carried out by placing the samples in an air circulating oven maintained at 325° C. for a period of 1 day and 7 days. After the heat aging was complete, the samples were placed at room temperature of 21° C. for a period of 24 hours. The samples were then bent on different cylindrical mandrels sized from higher diameter to lower diameter and the coatings were observed for any visible cracks at each of the mandrel size. Sample was considered as "Pass" if it showed no visible cracks when bent on a mandrel of diameter of 10 inches or less.

TABLE 4

| | 1 | 2 | 3 | 4 | 5 | 6 | 7 | 8 |
|---|---|---|---|---|---|---|---|---|
| Coating Type | | Organic | Organic | Inorganic | Inorganic | Inorganic | Inorganic | Inorganic |
| Coating Binder | Uncoated | PU | PVDF | Silicate | Silicate | Methyl Silicone | Silicate | Silicate |
| Visual Colour | | White | White | White | Grey | Grey | Dark Grey | Black |
| Measured Color Values | | | | | | | | |
| L* | | 92.65 | 78.555 | 84.925 | 67.48 | 60.12 | 43.495 | 15.54 |
| a* | | −1.7 | −0.655 | −0.27 | −0.8 | −1.68 | −0.49 | 0.17 |
| b* | | 0.075 | −0.605 | −2.185 | 2.41 | −4.04 | −2.015 | −0.13 |
| Solar Reflectance (R) | 0.701 | 0.74 | | 0.63 | 0.35 | 0.21 | 0.14 | 0.02 |
| Solar Absorptivity (A) | 0.299 | 0.26 | | 0.37 | 0.65 | 0.79 | 0.86 | 0.98 |

TABLE 4-continued

| | 1 | 2 | 3 | 4 | 5 | 6 | 7 | 8 |
|---|---|---|---|---|---|---|---|---|
| Emissivity (E) | 0.161 | 0.847 | | 0.889 | 0.86 | 0.86 | 0.882 | 0.91 |
| Temperature Reduction | | | | | | | | |
| Electrical | 109 | 89.3 (19.7%) | 87 (22%) | 90 (19%) | 68 (41%) | 64 (45%) | 89.5 (19.5%) | 84 (25%) |
| Electrical + Solar | 117.5 | 90.5 (22.9%) | 102.5 (12.7%) | 101 (14%) | 77 (40%) | 71 (46.5%) | 92 (21.7%) | 86.5 (26.2%) |
| Flexibility: Mandrel Test | | | | | | | | |
| Initial (Before heat ageing) | | Pass | Pass | Pass | Pass | Pass | Pass | Pass |
| After Heat ageing 325 deg. C. (1 day) | | Fail | Fail | Fail | Pass | Pass | Pass | Pass |
| After Heat ageing 325 deg. C. (7 days) | | Fail | Fail | Fail | | | Pass | Pass |

While particular embodiments have been chosen to illustrate the invention, it will be understood by those skilled in the art that various changes and modifications can be made therein without departing from the scope of the invention as defined in the appended claims.

What is claimed is:

1. A method for making a surface modified overhead conductor comprising the steps of:

(a) preparing a bare conductor, wherein step (a) comprises the steps of sand blasting the bare conductor, passing the bare conductor through an air wipe, and heating the bare conductor after the air wipe, wherein the heating is by direct flame exposure;

(b) applying a liquid coating mixture on the surface of the bare conductor to form a coated conductor; and (c) drying the coated conductor.

2. The method of claim 1, wherein after the air wipe, the number of particles, that are greater than 10 microns in size, on the surface of the bare conductor are lower than 1,000 per square feet of the conductor surface.

3. A method for making a surface modified overhead conductor comprising the steps of:

(a) preparing a bare conductor;

(b) applying a liquid coating mixture on the surface of the bare conductor to form a coated conductor, wherein step (b) further comprises passing the bare conductor through a flooded die and then through an air wipe; and (c) drying the coated conductor.

4. The method of claim 3, wherein the flooded die comprises an annular shaped portion with a center opening through which the bare conductor passes.

5. The method of claim 4, wherein the flooded die further comprises a tube for carrying the liquid coating mixture to the die.

6. The method of claim 4, wherein the flooded die comprises opening ports through which the liquid coating mixture is deposited on to the bare conductor.

7. A method for making a surface modified overhead conductor comprising the steps of:

(a) preparing a bare conductor;

(b) applying a liquid coating mixture on the surface of the bare conductor to form a coated conductor; and (c) drying the coated conductor, wherein step (c) comprises heating the conductor, and wherein the heating is by direct flame exposure.

* * * * *